United States Patent [19]

Kawaguchi

[11] 4,365,422

[45] Dec. 28, 1982

[54] METHOD AND APPARATUS FOR CONTINUAL TREATMENT OF TEXTILE SHEET MATERIAL BY APPLICATION OF MICROWAVES

[75] Inventor: Bunshiro Kawaguchi, Kyoto, Japan

[73] Assignee: The Ichikin, Ltd., Japan

[21] Appl. No.: 254,928

[22] Filed: Apr. 16, 1981

[51] Int. Cl.[3] ..... F26B 23/08

[52] U.S. Cl. ..... 34/1; 34/68; 34/147; 34/155; 219/10.55 R; 219/10.55 M

[58] Field of Search ..... 198/778; 34/1, 68, 155, 34/147; 219/10.55 R, 10.55 A, 10.55 M; 68/5 C, 5 D, 5 E

[56] References Cited

U.S. PATENT DOCUMENTS 772,695 10/1904 Crowell ..... 34/155

2,624,573 1/1953 Rice ..... 198/778

3,409,447 11/1968 Jeppson ..... 34/1

3,491,457 1/1970 Schreiber et al. ..... 34/1

3,718,082 2/1973 Lipoma ..... 219/10.55

*Primary Examiner*—Larry I. Schwartz

*Attorney, Agent, or Firm*—Lerner, David, Littenberg & Samuel

[57] ABSTRACT

Through a confined chamber replete with saturated or overheated steam, a textile sheet material such as a woven cloth is continually processed, under concurrent emanation of microwaves, along a continuous course made up of a plurality of substantially concentrically arranged, substantially circular sections of different diameters, for uniform treatment over entire length and thickness. The treatment can be used as a part of a continuous textile process.

7 Claims, 7 Drawing Figures

METHOD AND APPARATUS FOR CONTINUAL TREATMENT OF TEXTILE SHEET MATERIAL BY APPLICATION OF MICROWAVES

BACKGROUND OF THE INVENTION

The present invention relates to improved method and apparatus for continual treatment of textile sheet material by application of microwaves, and more particularly relates to improvement in continual treatment of a textile sheet material such as a woven cloth within an atmosphere replete with saturated or overheated steam under emanation of microwaves for uniform treatment effect over the entire length and thickness.

Fixation and development of dyes on a textile sheet material such as a woven cloth has long been carried out by placing the textile sheet material in an atmosphere impregnated with steam.

As a substitute for such a steam process, it was already proposed to subject a textile sheet material to emanation of microwaves in wet state. Here, the term "microwaves" refers to electro-magnetic waves having frequencies in a range from 300 to 30,000 MHz.

Use of microwaves has a wide variety of advantages in particular when they are used for treatments of a textile sheet material in wet state. First, they permeate into and heat the textile sheet material very quickly. Secondly, since their heat generation is dependent upon dielectric loss, they can be selectively absorbed in an object with large dielectric loss and, heat only necessary sections of the object. There is no heating of unnecessary sections of the object, thereby well avoiding extravagance of thermal energy. Thirdly, the object exposed to microwaves generate heat by itself which naturally raises the temperature of the ambient atmosphere. As a consequence, the amount of the thermal energy otherwise needed for heating the ambient atmosphere can be greatly reduced. Fourthly, since microwaves cause almost simultaneous temperature rise at different sections of the object exposed to them, regional variation in temperature within the object can be significantly minimized and this leads to ideal and uniform heating of the object. Finally, adjustment of the output voltage for microwave generation enables simple, easy and swift control of the heating condition in accordance with demands in actual treatment of textile sheet materials.

Emanation of microwaves onto a textile sheet is said to cause ionic conduction and dipole rotation of the fibers composing the material and water and/or agents contained in the material. This is believed to result in the swift and uniform heating of the textile sheet material.

Based on recognition of these advantages, various systems have been proposed in the field in order to utilize microwaves in practical treatments of textile sheet materials, but almost all of them were barely feasible in industrial scale.

One reason for such difficulty is the manner of microwave emanation. Various emanators are in general used to this end, and they are roughly classified into three major types, i.e. an emanator with a densely hairpin curved wave guide, and an open-type emanator.

In the case of the emanator equipped with the wave guide, the wave length of the emanated microwave wields a great influence upon the heating effect and, consequently, the textile sheet material is liable to undergo uneven heating to be caused by possible variation in the wave length. Stable control of the wave length is highly difficult in practice. As a result, the emanators of this type are quite unsuited for treatments of wet textile sheet materials which usually require high uniform heating effect and are susceptible to damages caused by fluctuating heating effect.

In the case of the open-type emanator having a metallic hexadral emanation chamber, it is strongly required to employ any special expedients to equalize the intensity of the magnetic field around the material placed in the emanation chamber. Otherwise, the emanators of this type do not operate satisfactorily in industrial scale although they may operate well in laboratory tests.

Another fact causing the difficulty in practical use of microwaves in fusion of fibers composing a textile sheet material. Such fusion is caused by microwaves themselves. This gives a serious problem in particular when the textile sheet materials is composed of thermoplastic synthetic fibers such as acrylic fibers. Such fusion of fibers is caused by presence of water and high boiling point agents in the textile sheet material after finishing and souring. For example, when a textile sheet material is made of acrylic fibers, swelling of the fibers starts at a temperature very close to 100° C. and, regardless of the dielectric constant, this swelling causes corresponding dipole rotation in the construction of the fibers. This dipole rotation results in abrupt evacuation of water and puts the fiber in arid state. Consequently, the temperature of the fiber rises quickly and such escalated temperature initiates fusion of the fibers composing the textile sheet material.

The other fact making practical use of microwaves difficult is the control of the above-described evacuation of water contained in the fibers. To this end, it is proposed to clamp a textile sheet material between a pair of running conveyer belts or place a textile sheet material on a running wet sheet during transportation through the microwave emanation zone. In either cases, there is high rate of danger that any contaminations on the belts or the sheets may be transferred to the textile sheet material during the treatment and this naturally causes serious degradation of the commercial value of the end product.

In order to remove such disadvantages inherent to the conventional textile treatment with microwaves, the inventor of the present invention has already proposed in U.S. Pat. No. 4,274,209 and in EPC Patent Application No. 79850116.9 to place a textile sheet material in the form of a roll within a confined chamber replete with saturated or overheated steam and rotate the roll under concurrent emanation of microwaves.

This proposed system well removed most disadvantages of the conventional textile treatment with microwaves. However, since the textile sheet material in this system is exposed to steam and microwaves in a roll form, there is a significant difference in treatment effect between the section of the textile sheet material close to the core of the roll and the section close to the periphery of the roll. As a consequence, one cannot expect uniform treatment effect over the entire length and textile sheet material.

In order to remove this advantage, a more dynamic system has also been proposed by the inventor of the present invention. In accordance with the dynamic system, a pair of rolls of a textile material are placed within a confined chamber replete with saturated or overheated steam, and the textile sheet material is continually transferred from one roll to another and vice versa under concurrent emanation of microwaves.

This improved system well solve the uniformity problem. However, since the textile sheet material has to kept, even provisionally, within the confined chamber during the treatment, this system is applicable to the so-called batch system process only. In other words, this system is quite unsuited to any continuous textile process in which a textile sheet material has to be continually transported from station to station.

SUMMARY OF THE INVENTION

It is the object of the present invention to apply a treatment by microwave emanation, as a part of a continuous textile process, to a textile sheet material with highly uniform treatment effect over the entire length and thickness of the material.

In accordance with the basic aspect of the present invention, a textile sheet material is continually advanced through a confined chamber replete with saturated or overheated steam and microwaves along a continuous course made up of a plurality of substantially concentrically arranged, substantially circular sections of different diameters.

In one preferred embodiment of the present invention, the above-described continuous course is defined by a plurality of substantially parallel guide rollers which are arranged, at given intervals, axially rotatably within the confined chamber along the periphery of an imaginary circle and adapted for winding thereabout the textile sheet material in the form of a cylindrical roll.

In another preferred embodiment of the present invention, the above-described continuous course is defined by a plurality of substantially parallel guide rollers which are arranged axially rotatably within the confined chamber along the peripheries of a plurality of substantially concentrically arranged imaginary circles, each circle containing a train of the guide rollers at given intervals, so that the textile sheet material takes the form of a plurality of substantially concentrically arranged, substantially circular, mutually spaced layers during its travel along the continuous course.

In the other preferred embodiment of the present invention, the above-described continuous course is defined by a pair of helically constructed perforated air ducts defining the passage for the textile sheet material therebetween, so that the textile sheet material takes the form of a helically arranged, mutually spaced layers during its travel along the continuous course.

BRIEF DESCRIPTION OF THE DRAWINGS

The above description, as well as further objects, features and advantages of the present invention, will be more fully understood by reference to the following detailed description of a presently preferred but nonetheless illustrative method and apparatus for continual treatment of textile sheet material by application of microwaves in accordance with the present invention when taken in conjunction with the accompanying drawings, wherein.

DESCRIPTION OF THE PREFERRED EMBODIMENTS

In the following description, elements substantially same in construction and operation but used for different embodiments are designated with same reference symbols.

Figure 1A:
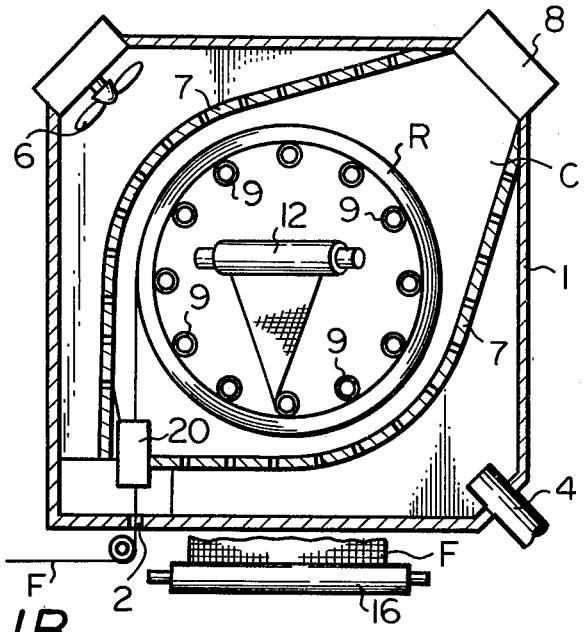
FIG. 1A is a top elevation of an apparatus for the continual treatment of textile sheet material in accordance with one embodiment of the present invention.
Figure 1B:
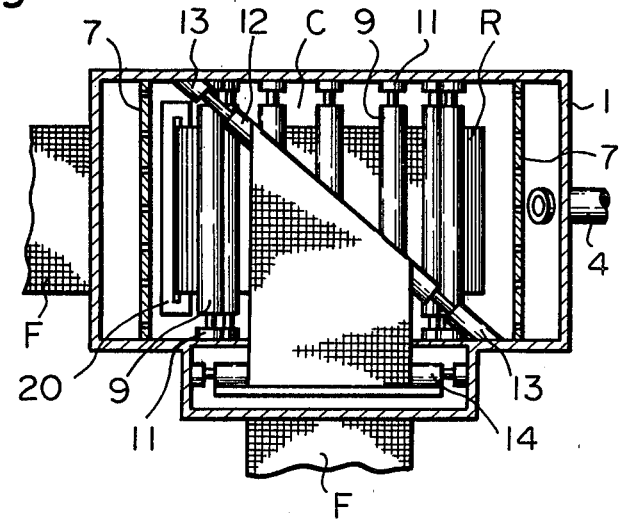
FIG. 1B is a rear elevation having a section removed of the apparatus illustrated in FIG. 1A.
Figure 1C:
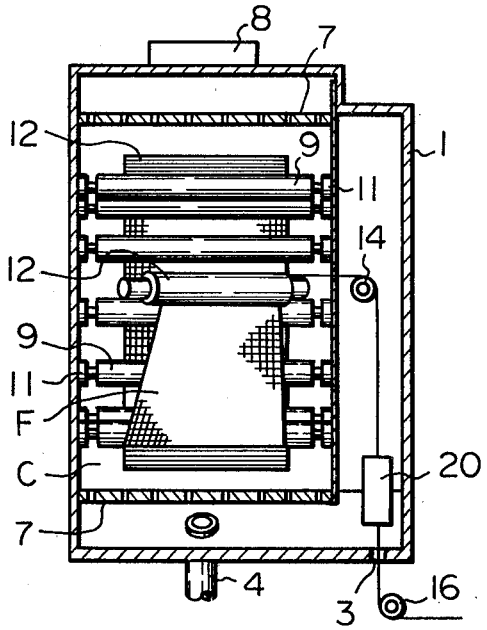
FIG. 1C is a side elevation having a section removed of the apparatus as illustrated in FIG. 1A.

The first embodiment of the apparatus in accordance with the present invention is shown in FIGS. 1A through 1C, in which a textile sheet material F to be treated is advanced along the above-described continuous course in the form of a cylindrical roll R and delivered outside the system from the innermost layer of the cylindrical roll R.

More specifically, the apparatus includes a housing 1 defining a substantially rectangular space and having an inlet 2 (see FIG. 1A) and an outlet 3 (see FIG. 1C) for the textile sheet material F. A supply tube 4 of saturated or overheated steam is mounted to the housing 1 whilst opening in the above-described space. Preferably, a fan 6 is mounted to the housing 1 within the space in order to stir the atmosphere within the space.

A confined chamber C is formed within the above-described space by means of perforated shelter walls 7 secured to the housing 1. At least one microwave emanator 8 is mounted to the housing 1 whilst opening in the confined chamber C. In the case of the illustrated construction, the microwave emanator 8 is internally accompanied with a microwave generator (not shown). Alternatively, the microwave emanator 8 may be connected to a separate microwave generator by a suitable electric connection.

A plurality of substantially parallel guide rollers 9 are arranged within the confined chamber C for free axial rotation by means of bearings 11 mounted to the walls of the housing 1. The guide rollers 9 are allotted, preferably at equal intervals, to different positions on the periphery of an imaginary circle. Although only twelve sets of guide rollers 9 are shown in the drawings for clear illustration, a lot more guide rollers 9 may be preferably arranged in practice.

Within the above-described imaginary circle, a delivery roller 12 is arranged for free axial rotation by bearings 13 secured to the walls of the housing 1. As best seen in FIG. 1B, the axial direction of this delivery roller 12 crosses the axial direction of the guide rollers 9 so that the textile sheet material F can be delivered in the axial direction of the above-described imaginary circle. Further guide rollers 14 and 16 are provided, the one within the housing 1 and the other outside the housing 1, in order to deliver the textile sheet material F outside the housing 1.

In order to block undesirable leakage of the steam and the microwaves, shelter assemblies 20 are arranged at or in the close proximity of the inlet 2 and the outlet 3.

Figure 5:
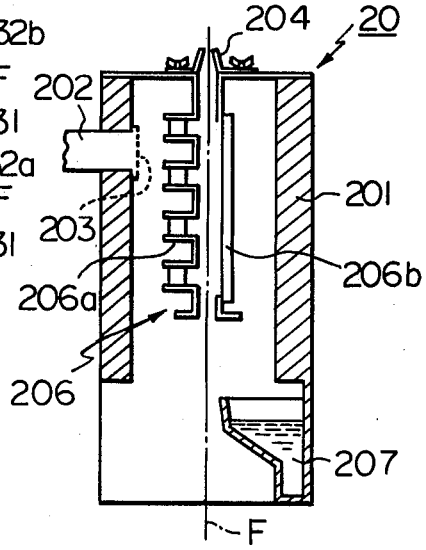

One example of the shelter assembly 20 to be used for the inlet 2 is shown in detail in FIG. 5, in which the shelter assembly 20 includes a thick housing 201 secured to the walls of the housing 1, a steam ventilation duct 202 opening in the space defined by the housing 201, and a perforated cover 203 closing the open end of the duct 202 in order to block undesirable leakage of electric waves through the duct 202. The top of the space is covered by an adjustable slit plate 204 providing a necessary but minimal passage for the textile sheet material F to be treated. That is, by adjusting the slit plate 204, the size of the passage can be changed on case-by-case basis. A block filter 206 is arranged vertically within the space below the slit plate 204. This block filter 206 includes a number of electric wave damping elements 206*a* aligned in the vertical direction and facing the traveling path of the textile sheet material. The block filter 206 further includes an electric wave absorber 206*b* vertically extending on the opposite side of the above-described traveling path.

The significantly small size of the passage provided by the slit plate 204 well blocks leakage of the steam and the microwaves out of the space defined by the housing 1 whilst allowing free passing of the textile sheet material F. Even when any amount of the microwave leak through the slit passage, they are almost fully enfeebled during their travel through the block filter 206 arranged below the slit passage. Preferably, a water reservoir 207 may be arranged in the space below the bottom of the block filter 206 in order to absorb microwaves which have survived even after the travel through the block filter 206.

In operation, saturated or overheated steam is first supplied into the space defined by the housing 1 via the supply tube 4 and flows into the confined chamber C through perforations of the shelter walls 7. Concurrently, the microwave emanator 8 is enabled. Thus, the confined chamber C is rendered replete with the saturated or overheated steam and the microwaves.

Under this condition, the textile sheet material F is introduced into the confined chamber C via the inlet 2 and the shelter assembly 20, and wound about the guide rollers 9 in order to form a cylindrical roll R. After a cylindrical roll R of a prescribed size is formed on the guide rollers 9, the leading end of the textile sheet material F is taken out from the innermost layer of the cylindrical roll R, and delivered outside the confined chamber C and further the space defined by the housing 1 via the delivery roller 9, the guide roller 14, the shelter assembly 20, the outlet 3 and the guide roller 16. Thereafter, the textile sheet material F is continually introduced into the confined chamber C and continually delivered therefrom at a delivery speed same as the introducing speed in order to enable the continual processing of the textile sheet material F for treatment.

Figure 2:
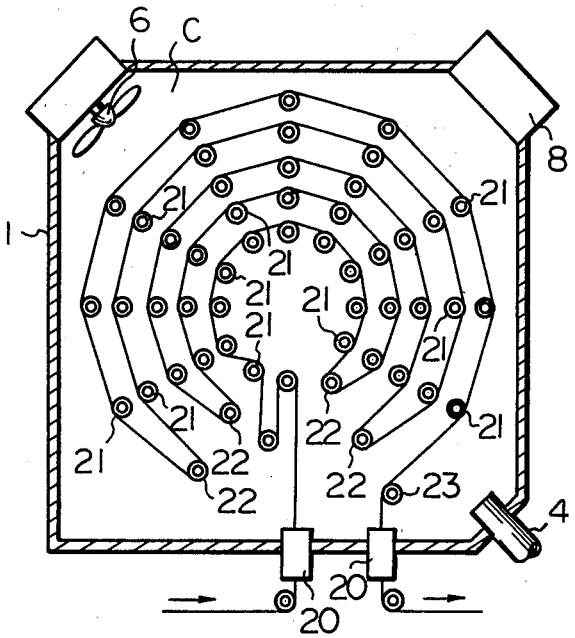
FIG. 2 is a top elevation of an apparatus for the continual treatment of textile sheet material in accordance with another embodiment of the present invention.

The second embodiment of the apparatus in accordance with the present invention is shown in FIG. 2, in which a textile sheet material F to be treated is advanced along the above-described continuous course in the form of a plurality of substantially concentrically arranged, substantially circular, mutually spaced layers and delivered from the outermost layer.

Like the first embodiment, the apparatus includes a housing 1, a supply tube 4 of steam, at least one microwave emanator 8, shelter assemblies 20 and preferably a fan 6. In the case of this embodiment, however, the housing 1 directly define a confined chamber C, and the shelter assemblies 20 form the inlet and outlet of the chamber C.

The apparatus further includes a plurality of axially rotatable guide rollers 21 which are arranged, at given intervals, along the peripheries of a plurality of substantially concentrically arranged imaginary circles. Each circle includes a train of the guide rollers 21. At positions near the ends of the trans of the guide rollers of the adjacent circles, transfer rollers 22 are arranged in order to transfer the textile sheet material F from the guide rollers 21 of one circle to the guide rollers 21 of the adjacent circle. A delivery roller 23 is arranged at a position outside the outermost imaginary circle. Depending on the situation, however, the delivery roller 23 may be located on the outermost imaginary circle next to the last guide roller 21 of the train belonging to that particular circle. Including these two possibilities, it is stated here that the delivery roller 23 is arranged in the vicinity of the outermost circle.

In operation, prior to full running, the textile sheet material F is introduced into the confined chamber 20 via the shelter assembly 20 and brought into engagement with the guide rollers 21 of the innermost train (first train). In the case of the illustrated example, the textile sheet material F is advanced, forming the first layer, in the clockwise direction in the drawing during its engagement with the guide roller 21 of the first train. After engagement with the last guide roller 21 of the first train, the textile sheet material F is passed over to the guide rollers 21 of the adjacent outer train (second train) via the transfer roller 22. The textile sheet material F is now advanced, forming the second layer, in the counterclockwise direction during its engagement with the guide rollers 21 of the second train. Thus, the advancing direction of the textile sheet material F in the second layer is opposite to that in the first layer.

After engagement with the last guide roller 21 of the second train, the textile sheet material F is passed over the guide rollers 21 of the adjacent outer train (third train) via the transfer roller 22. The textile sheet material F is then advanced, forming the third layer, in the clockwise direction during its engagement with the guide rollers 21 of the third train. Apparently, this advancing direction of the textile sheet material F in the third layer is opposite to that in the second layer, but equal to that in the first layer. In this way, the textile sheet material F is advanced in one direction in one layer and in the opposite direction in the next outer layer.

Finally, after engagement with the last guide roller 21 of the fifth train, the textile sheet material F is delivered outside the confined chamber C via the delivery roller 23 and the shelter assembly 20. After the above-described preparation is over, the full running of the textile sheet material F is initiated.

Figure 3:
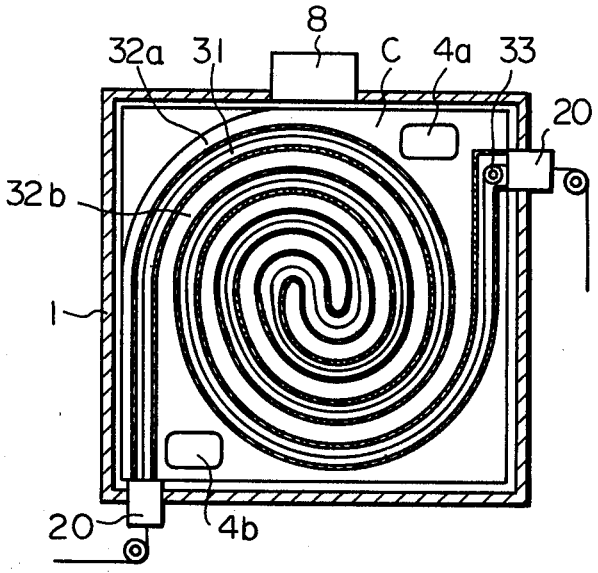
FIG. 3 is a top elevation of an apparatus for the continual treatment of an apparatus for the continual treatment of textile sheet material in accordance with still another embodiment of the present invention.

The third embodiment of the apparatus in accordance with the present invention is shown in FIG. 3, in which a textile sheet material F takes the form of a helically arranged, mutually spaced layers during its travel along the continuous course.

Like the foregoing embodiments, the apparatus includes a housing defining a confined chamber C, supply ports 4*a* and 4*b* of steam opening in the confined chamber C, at least one microwave emanator 8 and shelter assemblies 20 arranged at the inlet and outlet of the confined chamber C.

In the case of this embodiment, the above-described course for the textile sheet material F is defined by a passage 31 formed between a pair of perforated air ducts 32*a* and 32*b*. The air ducts 32*a* and 32*b* are constructed so that the passage 31 first converges towards the center of the confined chamber C and next diverges towards wall of the housing 1. Although not shown in the drawing, the air ducts 32*a* and 32*b* are coupled to a proper supply source of pressurized air so that blow of the air through their perforations keep the advancing textile sheet material F floating in the passage 31. A delivery roller 33 is arranged about the outlet terminal of the passage 31.

Figure 4:
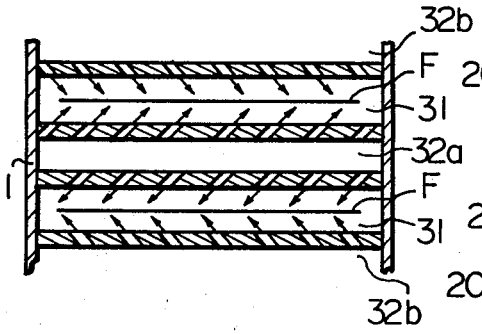
FIG. 4 is a partial cross-sectional elevation of a portion of the apparatus illustrated in FIG. 3 showing the perforated air ducts included therewith; and, FIG. 5 is a cross-sectional elevation of a shelter assembly adapted for use in accordance with the embodiments of the present invention.

As shown in FIG. 4, the perforations formed in the mating walls of a pair of air ducts 32*a* and 32*b* should preferably be directed sideways in a same direction with an appropriate inclination with respect to the surface of the textile sheet material F to be processed so that the textile sheet material F can be stretched in the width direction during the treatment due to the pneumatic force. More preferably, the textile sheet material F should be stretched in opposite width directions in the adjacent layers.

I claim:

1. A method for continuous treatment of textile sheet material by application of microwaves comprising the steps of, continuously introducing said textile sheet material into a confining chamber, continuously winding said textile sheet material in the form of a cylindrical hollow roll comprising a plurality of contiguous layers of textile sheet material about a plurality of substantially parallel guide rollers arranged within said chamber at predetermined intervals along the circumference of an imaginary circle, supplying steam into said chamber and within said hollow roll, continuously delivering the innermost layer of said textile sheet material from said cylindrical hollow roll towards the outside of said chamber as said textile sheet material is being continuously wound about the outermost layer of said cylindrical hollow roll, and emanating microwaves into said chamber during passage of said textile sheet material therethrough.

2. The method as set forth in claim 1 wherein said delivering of the innermost layer of said textile sheet material towards the outside of said chamber is in the axial direction of said imaginary circle.

3. An apparatus for the continuous treatment of textile sheet material comprising, a housing including a confining chamber having an inlet and an outlet for the continuous passage of said textile sheet material therethrough, a plurality of substantially parallel guide rollers arranged within said chamber at predetermined intervals along the circumference of an imaginary circle for continuously winding thereabout said textile sheet material in the form of a cylindrical hollow roll comprising a plurality of contiguous layers of said textile sheet material, a microwave emanater mounted to said housing in operative communication with said chamber, supplying means for supplying steam into said chamber and within said hollow roll, advancing means for advancing said textile sheet material through said chamber, and delivering means arranged in said chamber within the confines of said guide rollers for continuously delivering the innermost layer of said textile sheet material from said cylindrical hollow roll towards the outside of said chamber as said textile sheet material is being continuously wound about the outermost layer of said cylindrical hollow roll.

4. The apparatus as set forth in claim 3 wherein said confining chamber comprises perforated shelter walls arranged within said housing.

5. The apparatus as set forth in claim 3 wherein said delivering means comprises a delivery roller mounted within the confines of said guide rollers for axial rotation.

6. The apparatus as set forth in claim 5 wherein said delivery roller is further arranged such that its axial direction crosses the axial direction of said guide rollers whereby said textile sheet material is delivered from said chamber in the axial direction of said imaginary circle.

7. The apparatus as set forth in claim 3 further including shelter assemblies attached to said inlet and outlet of said confining chamber in order to block leakage of microwaves emanating from said microwave emanater while allowing passage of said textile sheet material therethrough.

* * * * *